United States Patent [19]

Winkler et al.

[11] Patent Number: 4,706,543

[45] Date of Patent: Nov. 17, 1987

[54] UPWARDLY SWINGING PINILE MOUNTING FOR A GUN BARREL FOR A COMBAT VEHICLE

[75] Inventors: Gert Winkler, Meerbusch; Erich Zielinksi, Haan, both of Fed. Rep. of Germany

[73] Assignee: Rheinmetall GmbH, Duesseldorf, Fed. Rep. of Germany

[21] Appl. No.: 794,745

[22] Filed: Nov. 4, 1985

[30] Foreign Application Priority Data

Nov. 2, 1984 [DE] Fed. Rep. of Germany ..... 3440041

[51] Int. Cl.[4] ..... F41F 23/02

[52] U.S. Cl. ..... 89/38; 89/39

[58] Field of Search ..... 89/38, 39, 36.15, 43.01; 188/299, 317

[56] References Cited

U.S. PATENT DOCUMENTS

| | | | |
|---|---|---|---|
| 377,954 | 2/1888 | Noble | 89/39 |
| 381,980 | 5/1888 | Hoyle | 89/38 |
| 769,636 | 9/1904 | Rausenberger | 89/39 |
| 4,326,446 | 4/1982 | Magnuson | 89/38 |
| 4,356,898 | 11/1982 | Guzder et al. | 188/317 X |
| 4,463,838 | 8/1984 | Jacottet | 188/299 |
| 4,485,722 | 12/1984 | Metz et al. . | |
| 4,502,673 | 3/1985 | Clark | 188/299 X |

FOREIGN PATENT DOCUMENTS

| | | |
|---|---|---|
| 110659 | 4/1899 | Fed. Rep. of Germany . |
| 317025 | 4/1918 | Fed. Rep. of Germany . |
| 3015097 | 2/1984 | Fed. Rep. of Germany . |
| 1160125 | 7/1958 | France . |

*Primary Examiner*—John F. Terapane
*Assistant Examiner*—John S. Maples

[57] ABSTRACT

A piston cylinder unit of an upwardly swinging pinile mounting necessary for the adjustment of the muzzle height of the gun barrel of a battle tank contains a bracking mechanism which becomes effective at firing at each upwardly swingable setting of the gun barrel. In this way it is possible to utilize the swinging motion of a gun mount arm carrying a gun barrel for the recoil energy release of the gun barrel. The barrel recoil energy of the gun barrel, and of the masses recoiling at the same time with the gun barrel, is thereby energy dissipatingly absorbed at the barrel recoil, after completing the free-running switching operation d of a known barrel recoil brake mechanism within a barrel recoil path c, jointly formed out of the recoil ranges a and b, on the one hand, by way of the piston cylinder unit over the gun mount arm swung back by an angle $\alpha$ corresponding to the barrel recoil range a and on the other hand by way of a cradle fixed backwardly moving recoil brake mechanism by a comparably short range b. In this way known gun barrels, installed in tank turrets as well as short stroke recoil brake mechanism with a free run, are installable, while sparing weight and manfacturing effort, whereby, nevertheless, the long recoil path for the braking of the gun barrel while not endangering the stability of the tank vehicle is guaranteed with muzzle heights greater than 4 m.

6 Claims, 6 Drawing Figures

UPWARDLY SWINGING PINILE MOUNTING FOR A GUN BARREL FOR A COMBAT VEHICLE

BACKGROUND OF THE INVENTION

The subject of this invention is an upwardly swinging pinile mounting for a gun barrel for a battle vehicle such as a tank. The mounting has at least one piston cylinder unit for adjusting the muzzle height of the gun barrel which is connected, allowing for a swingable movement on its cylindrical end, with the traversely positioned part of a battle vehicle, and on its piston side end, with a gun mount arm carrying the gun; and with a barrel recoil brake mechanism attached to the gun barrel cradle, which provides for a free-running switching operation for the resistance free barrel recoil during the passing through of the gun barrel of a projectile.

This type of pinile mount is known in the art and described, for example, in U.S. Pat. No. 4,326,446 to Magnuson.

In the operation of this pinile mount with comparably large muzzle heights greater than 4 meters, it is necessary, in order to realize sufficient stability of the battle vehicle, to increase several times the deceleration path of the barrel recoil at firing over against a gun barrel situated in a tank turret transferring a high firing force. Therefore, the pinile mount results in a long barrel recoil path which makes it necessary to construct, in precisely the same length, the support of the recoiling barrel carried by the pinile mount, the barrel recoil brake mechanism, as well as the barrel counter-recoil mechanism.

Such long gun barrel supports, barrel braking, as well as barrel counter-recoil mechanisms, however, have the disadvantage of being very heavy and require a not inconsiderable technical manufacturing effort.

SUMMARY OF THE INVENTION

The purpose of the invention is to construct a pinile mount for the gun barrel with a battle vehicle in such a way that the weight and the manufacturing effort is minimal; that the gun barrel usually installed in a turret of a battle vehicle transferring a high firing force, already known to the art, preferably combined with a barrel recoil braking mechanism and counter-recoil mechanism resulting in a short recoil path, can be installed with the pinile mount of a battle vehicle with a firing height greater than 4 meters, without the stability of the battle tank being endangered during firing.

The pinile mounting in accordance with this invention, in a preferred embodiment thereof, has at least one piston cylinder unit for adjusting the muzzle height of the gun barrel which is connected, allowing for a swingable movement on its cylindrical end, with the traversely positioned part of a battle vehicle, and on its piston side end, with a gun mount arm carrying the gun; and with a barrel recoil brake mechanism attached to the gun barrel cradle, which provides for a free-running switching operation for the resistance free barrel recoil during the passing through of the gun barrel of a projectile. The piston cylinder unit needed for the adjustment of the muzzle height h of the gun barrel contains a braking mechanism which becomes effective at the firing at each upwardly swingable setting of the gun barrel, whereby the recoil energy of the gun barrel and of the masses recoiling at the same time with the gun barrel at the time of the barrel recoil, after completing the free run (d) of the barrel recoil brake mechanism within a barrel recoil path (c), jointly formed out of the barrel recoil ranges (a) and (b) its energy dissipatingly absorbed, on the one hand by way of the piston cylinder unit over the gun mount arm swinging back by an angle $\alpha$ corresponding to the barrel recoil range (a), and on the other hand by way of cradle fixed barrel recoil brake mechanism moving backwards by the range b.

The invention makes it possible, in an advantageous manner, to utilize the swivel movement of a gun mount arm, carrying a gun barrel, for the recoil energy release of the gun barrel. Thereby, with minimum weight and manufacturing effort, gun barrels commonly installed in tank turrets and transferring a high firing energy, as well as short stroke, preferably combined recoil brake and barrel counter-recoil mechanisms, are installable, which for the recoil include a free running switching operation (termed relaxation oscillation), which, nevertheless, with muzzle heights greater than 4 meters guarantees a longer recoil path for the braking of the gun barrel and does not endanger the stability of the tank vehicle.

In a particularly advantageous construction the total recoil energy of the gun barrel (which also includes the recoil energy of the parts recoiling with the barrel), for example, the cradle fixed recoil brake mechanism is energy dissipatingly absorbed during the firing after completing the free run of the recoil mechanism at the same time during the backswing of the gun mount arm by the angle $\alpha$ by way of a braking medium of a piston cylinder unit adjustable to the muzzle height of the gun barrel and, by way of a barrel recoil braking mechanism which is known to provide a short brake path "b".

On the basis of this braking possibility of the barrel recoil by way of the braking medium of the piston cylinder unit in addition to the cradle fixed recoil brake mechanism, it is possible to achieve large brake paths "c" of the gun barrel by way of the possibility of swinging back the gun mount arm with a comparably minimal operative braking force at the trunnions.

Independent of the amount of braking energy, on the one hand of the recoil brake mechanism, and the other hand of the braking mechanism of the piston cylinder unit, the braking range "a" of the braking mechanism, and "d" of the recoil brake mechanism, allow themselves to be adjusted to one another in such a way that the recoil path "b" remains comparably small. In this way, the braking range a is greater than b, preferably "a"/"b"=2/1, and allows for a reduction in manufacturing effort and weight, result in a comparably small recoil length within the cradle support and comparably small structural units for the recoil brake mechanism, whereby, even with large muzzle heights, the possibility exists to reduce the braking range "b" in such a way that the braking range closely corresponds to the maximum barrel recoil path "c".

An acceptable stability of the tank vehicle can be obtained at firing with comparably small braking range lengths "b" of a known recoil brake mechanisms and with muzzle heights greater than 4 meters as well as braking range lengths "a"/"b"=2/1. For example, with a muzzle height of 5.5 m of a battle tank gun barrel attached to the gun mount arm over the trunnions, a braking force reduction acting on the trunnions guaranteeing the stability of the tank vehicle can be achieved, with a braking range ratio a/b=2/1, whereby the braking force is reduced from 600 kN to 200 kN.

Because the braking medium can be constructed as a pressure resistant valve, or as an electrohydraulic servo valve, whereby the throttle cross section of the servo valve is controllable, during the recoil rearwardly moving piston rod of the piston cylinder unit recoil, and pressure dependent of the resulting brake pressure in the recoil brake mechanism, it is further advantageous that the braking force can be held nearly constant over the total barrel recoil path, whereby the reduced braking force acts sparingly upon the mounting, the recoil brake mechanism and the piston cylinder unit.

BRIEF DESCRIPTION OF THE DRAWINGS

The invention is more fully disclosed in connection with the various views illustrated in the drawings.

In the Drawings.

DETAILED DESCRIPTION

Figure 1:
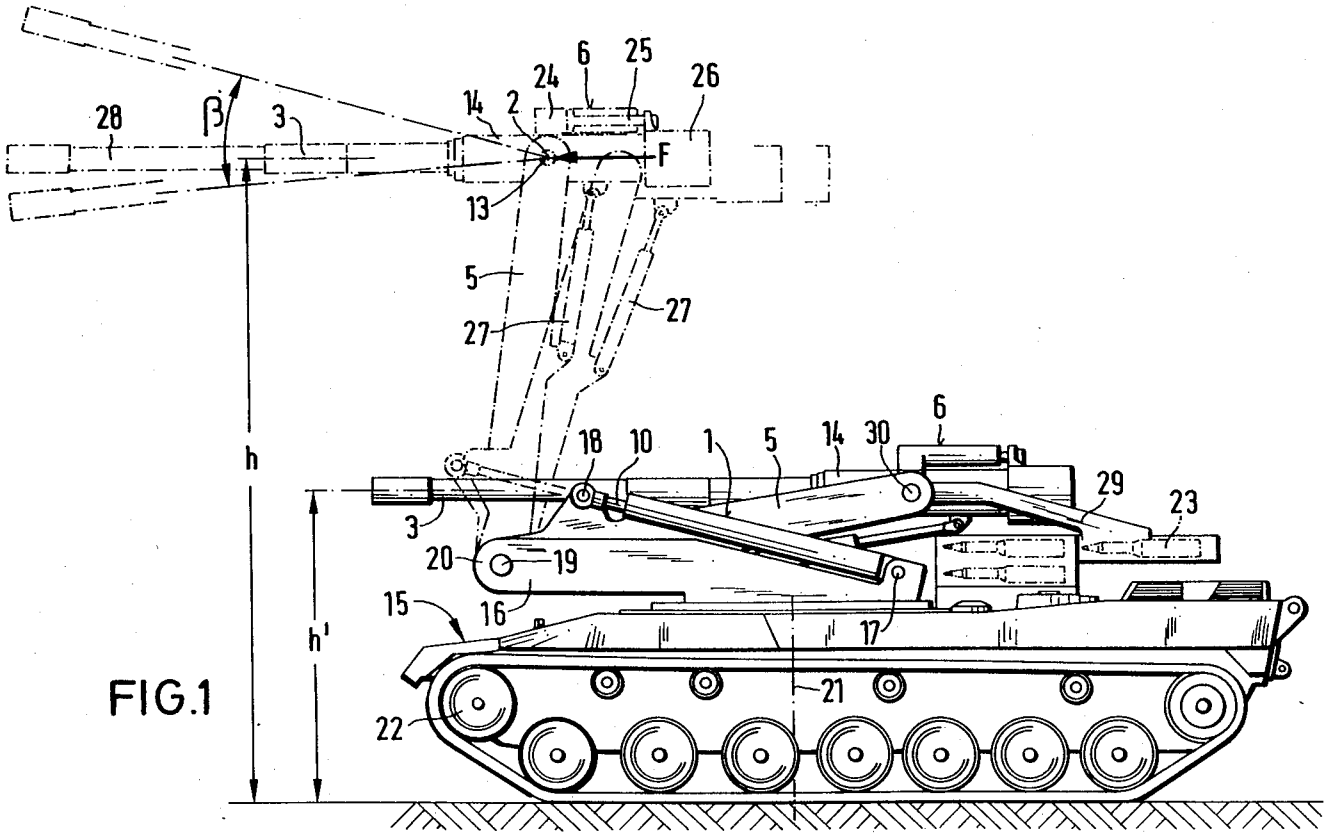
FIG. 1 is a side view of a gun barrel pinile mounted on a battle tank, with a cradle fixed recoil mechanism jointly braking the recoil path, and a piston cylinder unit of the pinile mount containing a braking mechanism and adjusting the muzzle height of the gun barrel.
Figure 2:
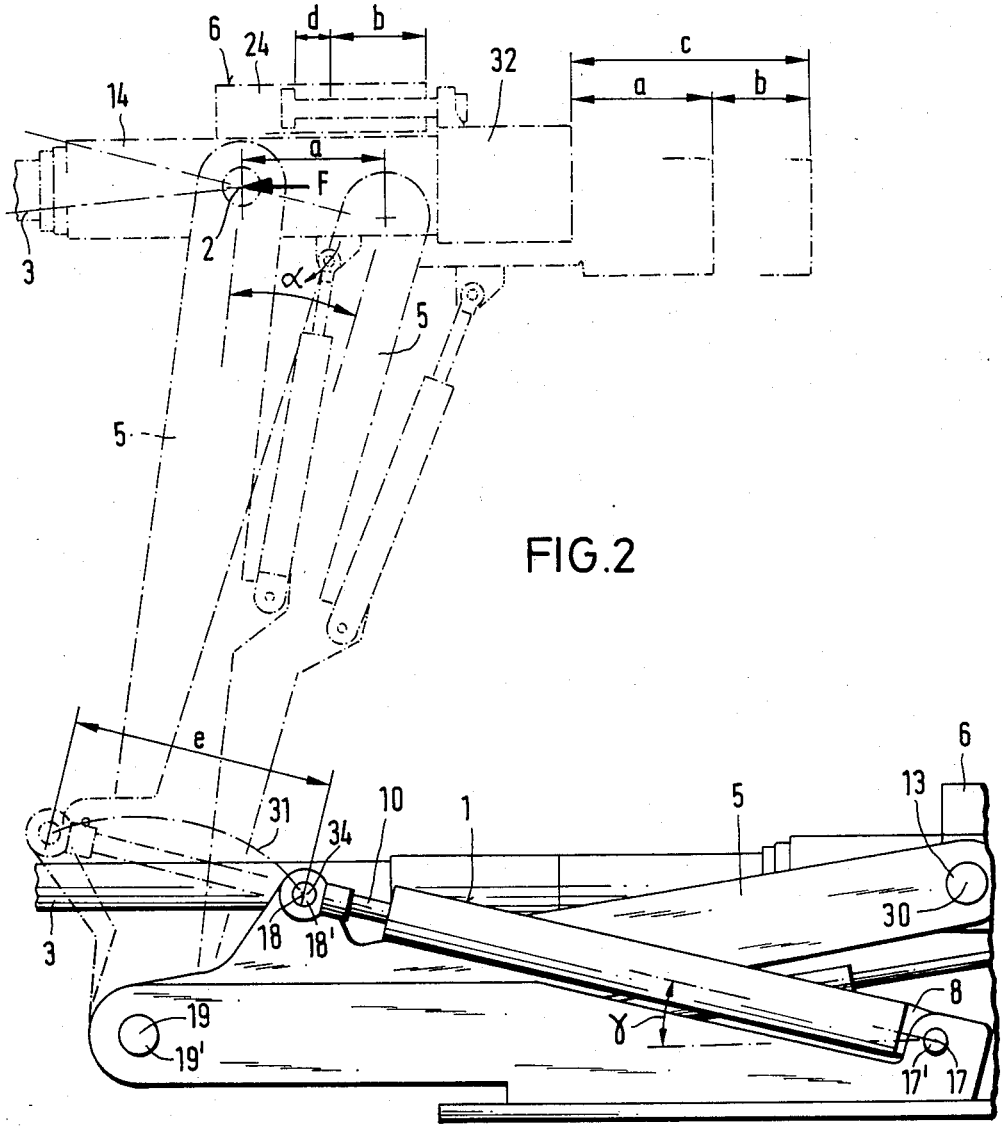
FIG. 2 is an sectional enlargement of the pinile mounted gun barrel in FIG. 1.

The upwardly swingable pinile mounting for the gun barrel 3 of the battle tank 15, as represented in FIGS. 1 and 2, consists essentially of two gun mount arms 5 carrying the gun barrel 3 on both sides and of two piston cylinder units 1 adjusting the muzzle height h of the gun barrel 3. Due to the symmetrical arrangements of the one gun mount arm 5 and the piston cylinder unit 1 on both sides of the gun barrel 3, only gun mount arm 5 and one piston cylinder 1 can be seen in side views of the pinile mounting. The cylinders 8 of the piston cylinder 1 are pivotally connected, allowing for swivel motion over the bearing bolts 17' and 18', with a part 16 traversely positioned over the axis 21 of the tank hull 22 at the bearing sites 17, and with the piston rod 10 of each piston cylinder unit 1 at each bearing site 18 of the gun mount arm 5.

The traversely positioned part 16 contains at the ends 20 positioned opposite the bearing sites 17, additional bearing sites 19 to which each gun mount arm 5 is pivotally attached upwardly swinging over bearing bolts 19.

The gun barrel 3 rests within the gun barrel cradle 14, whereby it can recoil and counter-recoil in a gun cradle position during the passing through the gun barrel of a projectile 23 by a resistant free run "d" and a braking range b of a barrel recoil brake mechanism 6, which preferably is equipped with a counter-recoil mechanism (not shown) in the diagram. The recoil and counter-recoil path ("b"+"d") of the recoil brake mechanism 6 is short and corresponds to the short recoil path of recoil brake mechanisms known in the art, which, without endangering the stability of the known tank vehicles, are installed in order to brake gun barrels transferring a high firing energy installed in a turret of a battle tank. This type of, for instance, combined recoil brake and counter-recoil mechanism with free run and a short brake stroke are known and described in the coassigned West-German Pat. No. DE-PS 3 015 097.

The cylinder 24 of the recoil brake mechanism 6 is firmly connected in a known manner with the gun cradle 14, while its piston 25 (FIG. 1) is connected to the recoil and counter-recoiling breech end 26 of the gun barrel 3. The gun barrel cradle 14 contains, externally, trunnions 13 arranged on both sides for resting in the gun mount arm 5, around whose axis the gun barrel 3 is adjustable in height through an angle range $\beta$ in an upwardly swingable setting 2 of the piston cylinder unit 1 in the muzzle height "h", by way of fixed elevating cylinders 27 on each gun mount arm 5.

The elevating cylinders 27 can stabilize the gun barrel 3 in such a way that, in an assumed firing setting 28 within an angle range, $\beta$, it keeps its target directed position during the recoil and counter recoil. A battle tank has, in addition, a sighting mechanism, not shown, for sighting the target. A swingable loading mechanism 29 is attached to the gun barrel cradle 14 for loading the gun barrel 3 whose construction and function, however, is not essential to the invention and, therefore, is not further explained.

The piston cylinder unit 1 can swing the gun mount arm 5 upwards out of a resting nearly horizontal starting position on the tank hull 22 to practically vertical maximum position. The position of the gun barrel 3, when at the starting position of the gun mount arm 5, is found at the lowest muzzle height "h'" (FIG. 1) corresponding to the starting setting. In the fitting position of the piston cylinder unit 1 with a comparably flat and only minimal angle of inclination of $\beta$ less than 30 degrees, only a minor space saving piston stroke "e" of the rod 10 is necessary in order to swing up the gun mount arm 5. During the stroke "e", the bearing site 18 moves in circular path 31 in such a way around the bearing site 19 that the slanted position of the piston cylinder unit 1 is not significantly altered.

Figure 4:
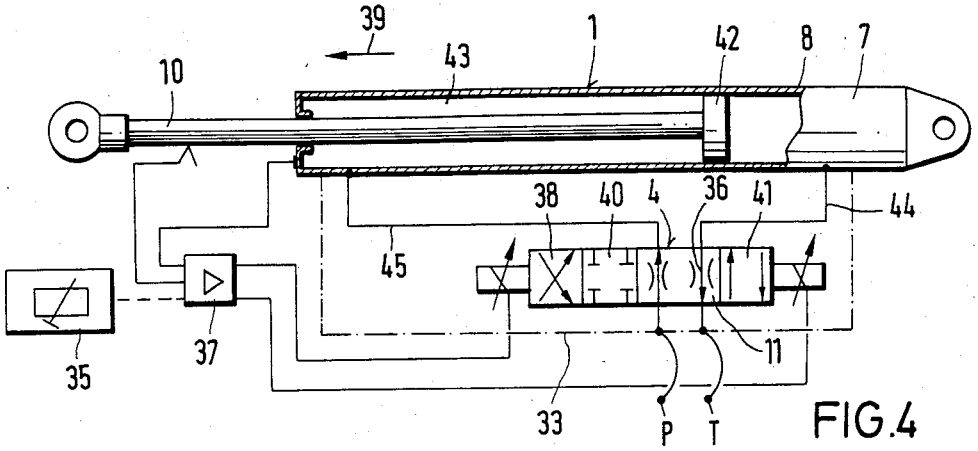
FIG. 4 is a schematic diagram of the piston cylinder unit with an electrohydraulic servo valve constructed as a braking medium.
Figure 5:
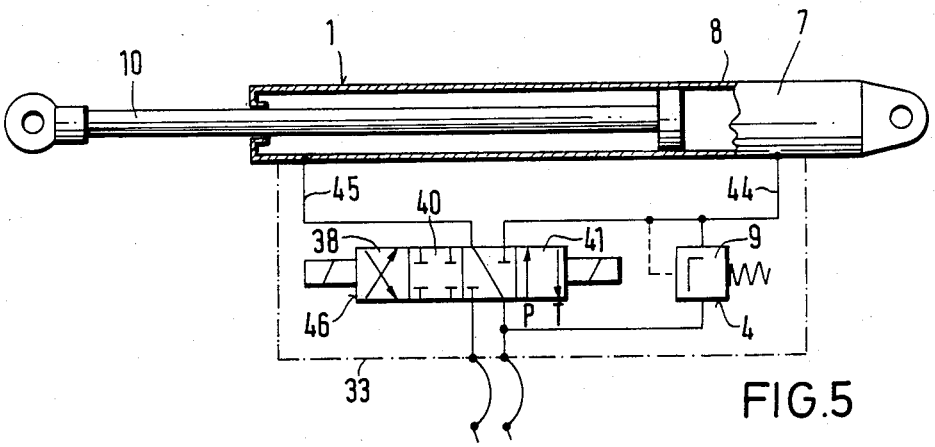
FIG. 5 is a schematic diagram, showing a pressure resistance valve connected externally to the piston cylinder unit as a braking mechanism.
Figure 6:
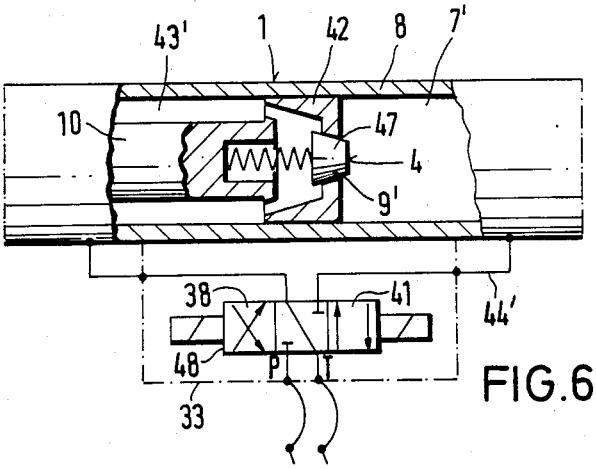
FIG. 6 is a schematic diagram, showing a pressure resistance valve installed within the piston cylinder unit as a braking mechanism.

Each piston cylinder unit 1 pictured in FIGS. 4–6 has a braking mechanism 4 and a control unit 33. The braking mechanism 4 in recoil range "a" of the trunnions 13 and, therefore, also the gun barrel 3, fulfills the purpose of making the reverse swinging motion of the gun mount arm 5, in the angle sector $\alpha$, useful for the recoil energy release of the gun barrel 3 and for the other recoiling masses of the gun barrel 3. The braking mechanism 4 is effective at firing in each upwardly swingable setting 2 of the gun barrel 3. The recoil energy of the gun barrel 3, the breech 32, and the additional recoiling masses of the gun barrel 3 are simultaneously energy dissipatingly absorbed after completion of the free run d of the barrel recoil brake mechanism 6 with the barrel recoil. This occurs within a barrel recoil path "c" jointly formed out of the barrel recoiling ranges ("a"+"b"). At the same time, on the one hand, the piston cylinder unit 1 absorbs energy via the backward swinging gun mount arm 5 over the barrel recoil range a corresponding to the angle $\alpha$, and on the other hand, by way of the cradle fixed recoiling barrel recoil brake mechanism 6 by a range "b".

Figure 3:
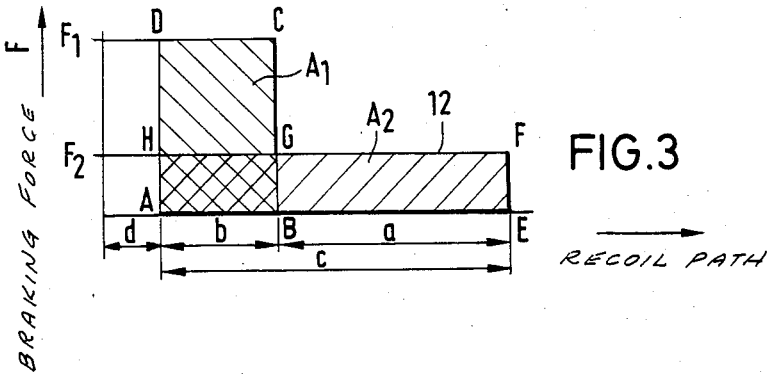
FIG. 3 is a brake force diagram, the brake effect of the recoil brake mechanism and the brake mechanism of the piston cylinder unit as well as the reduced braking force acting on the trunnions.

In this way, as shown in the diagram according to FIG. 3, the braking force F acting upon the trunnions 13 is reduced in such a way that an adequate stability of the tank vehicle 22 exists with firing heights h greater than 4 m, with the usual employment of high firing energy transferring gun barrel 3 installed in a turret of a battle tank. In this way a steady stability of the tank vehicle 22 can be achieved with muzzle heights "h" up to 8 m.

At the smallest muzzle height "h'" a gun barrel 3 is braked at the starting setting solely by way of the known method by the recoil brake mechanism 6 within the recoil range "b", because the piston rod 10 has reached its pushed through end position 34 (FIG. 2) in the cylinder 8 and an additional swinging of the gun mount arm 5 is not possible. The braking force $F_1$ acting on the trunnion 13 is comparably large due to the small breaking range "b", however, the stability of the tank hull 22 is not endangered due to the small muzzle height "h'".

The braking effect $A_1$ of the recoil brake mechanism 6 corresponds to the product of the force $F_1 \times$braking range "b" and, therefore, with the points A, B, C, D enclosed rectangular surfaces.

At large muzzle heights "h", preferably over 4 m, with which a maximum recoil path "c" is possible from the existing recoil or brake ranges ("a"+"b"), the same braking effect $A_2$ equals $A_1$ on the trunnion 13 corresponding to the product $F_1 \times$braking range b effects a reduced braking force $F_2 = F_1 \times b/(a+b)$ relative to the elongation of the braking path.

The braking mechanism 4 of the piston cylinder unit 1 and the hydraulic damping effect of the recoil brake mechanism 6 are synchronized in such a way during the jointly proceeding brake processes of both brake mechanism 4, 6, that the braking force $F_2$ acting on the trunnion 13 of the gun barrel cradle 14 is nearly constant within the barrel recoil path "c". With respect to the braking paths "a", respectively "b", the braking effect produced by the braking mechanism 4 corresponds to the product $F_2 \times$"a" and, therefore, with the points B, E,F, G, enclosed rectangular surfaces; and the braking effect produced by the recoil brake mechanism 6 corresponds to the product $F_2 \times b$ and, therefore, with the points A, B, G, H enclosed rectangular surfaces. Therefore, the total braking effect $A_2$ corresponds to the points A E, F, H enclosed rectangular surfaces.

At continually smaller muzzle heights "h", in particular less than 4 m, the horizontal recoil range "a" of the trunnions 13 and, therefore, of the gun barrel 3 continuously decreases in the lower swinging range of the gun mount arm 5. Therefore, the braking force increases with the same braking effect $A_2$ and continuously smaller braking ranges "a" of the braking mechanism 4 over the amount of the braking force $F_2$, until it has reached the amount of the braking force $F_1$ at the muzzle height "h'".

The braking mechanism 4 is connected with the hydraulic medium displaced cylinder portion 7, 7' of the cylinder 8 belonging to the piston cylinder unit 1 during the barrel recoil and can be placed within the cylinder 8 (FIG. 6) or outside the cylinder 8 external to the cylinder portion 7 (FIGS. 4 and 5). Next to the cylinder portion, 7, 7' a sliding piston 42 within the cylinder 8 attached to the piston rod 10 produces an additional cylinder portion 43, 43' necessary for the dual sided motion of the piston rod 10.

The braking mechanism 4, according to FIGS. 4 and 5, is integrated in a control unit 33 with the arrangement external to the cylinder 8.

The braking mechanism 4, in accordance with FIG. 4, is an electro hydraulic servovalve 11, whose cross sectional passage 36 is throttleable in order to achieve a nearly constant brake pressure flow 12 (FIG. 3) path independent of the backwardly moving piston rod 10 of the piston cylinder unit 1 during the barrel recoil over a control element amplifier 37, and pressure dependent of the brake pressure existing in the recoil brake mechanism 6 over a pressure pick-up 35 connected with the control element amplifier 37. During the braking procedure, the cylinder portion 7 is connected by way of a conduit 44 with the throttleable cross section of passage 36, and the cylinder portion 43 is connected by way of a conduit 45 with a hydraulic energy source not shown in the drawing, whereby the cross section of passage in the cylinder portion 43 is likewise throttled. The servo valve 11 in the switch position 38, after completing the braking range a, is in the position to move the piston rod 10 forwards in the direction 39, whereby the gun mount arm 5 (FIG. 1) again moves the trunnions 13 forwards into the setting 2. A change in setting 2 (FIG. 1) is not possible in the switch position 40, while the piston rod 10 can be moved backwards in the opposite direction 39 in the switch position 41 and, therefore, is adjustable to smaller muzzle heights "h".

The braking mechanism 4, according to FIG. 5, is constructed as a pressure resistance valve 9 which during the barrel recoil range "a", is connected with a non-throttleable 4/4 flow valve 46 within the control unit 33. Thereby the braking procedure likewise produces a predetermined constant braking force. The switch positions 38, 40, 41 necessary to change the muzzle height "h" correspond with the already described switch positions according to FIG. 4.

FIG. 6 makes evident the arrangement of a braking mechanism 4 constructed as a pressure resistance valve 9' within a piston 42. A braking movement of the piston rod 10 within the cylinder 8 is possible with the maintenance of a constant braking force, by the opening of a valve cone 47 within the cylinder portion 7 only after overcoming the advance pressure. The conduit 44' of the piston portion 7' remains closed during the braking procedure. In order to change the muzzle height "h" (FIG. 1) a 4/3 flow valve 48 with an additionally prescribed switch position 38, 41 is necessary within the control unit 33.

The switch positions drawn in FIGS. 4–6 correspond to the international norm ISO 1219.

According to an example which is not shown, it is also possible to equip the pinile mounting with only one piston cylinder unit 1 and the respective braking mechanism 4. In this connection, it is only necessary to have one mount arm 5 for changing the height of the gun barrel 3, which, however, in order to be fastened on both sides of the gun barrel 3 opens to a fork in the area of the trunnion 13.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. Upwardly swingable pinile mounting for a gun barrel mounted on a cradle of a battle tank with at least one piston cylinder unit for adjusting the muzzle height of the gun barrel which unit is pivotally connected at its cylindrical end with a transversely adjustable part of the battle tank, and is pivotally connected at its piston side end with a gun mount arm carrying the gun barrel; and with a barrel recoil brake mechanism connected to the gun barrel cradle; said piston cylinder unit adjusts the muzzle height "h" of the gun barrel and includes a braking means; said means includes a passage cross-section for effecting a nearly constant brake pressure via a control element amplifier dependent on the piston rod movement of the piston cylinder unit during recoil of the gun barrel and pressure-dependent on the hydraulic pressure that accrues in a barrel recoil braking mechanism which is operatively mounted in the gun barrel cradle, said pressure being throttled, said barrel brake mechanism effecting a resistance free gun barrel recoil "d" during the initial recoil of the gun barrel, whereby said recoil of the gun barrel includes recoil path regions "a" and "b" which jointly form the recoil path "c" of the recoiling masses formed by the gun barrel and parts connected thereto, the energy of said recoiling masses is simultaneously absorbed on the one hand by the piston cylinder unit over the recoil path region "a" which corresponds to the angle $\alpha$ traversed by the gun mount arm connected thereto, and, on the other hand, by the barrel brake mechanism over the recoil path region "b", and said barrel brake mechanism and braking means jointly producing a nearly constant force F at the trunnion of the gun barrel cradle during the braking process of the recoil path "c".

2. Pinile mounting as in claim 6, including the following features:

(a) the braking means is joined with a hydraulic medium displaced cylinder portion of the piston cylinder unit during the barrel recoil and, (b) the braking means is arranged on the outlet side of the cylinder portion external to the cylinder of the piston cylinder unit or within the cylinder.

3. Pinile mounting as in claim 1, wherein the braking, means is a pressure resistance valve.

4. Pinile mounting as in claim 1, wherein the braking means is a electro-hydraulic servovalve whose passage cross-section is independent, during the barrel recoil of the backwardly moving piston rod of the piston cylinder unit, of the brake pressure created in the recoil brake mechanism, and is throttleable in order to achieve nearly constant braking force process.

5. Pinile mounting as in claim 1, whereby the braking force F at the trunnion of the gun barrel is essentially absorbed as a minimum muzzle height "h'" brake mechanism over recoil path region "b".

6. Pinile mounting as in claim 5, whereby at muzzle height "h">4 m the same braking effect is produced over the recoil path "c" as is present at minimum muzzle height "h'" which is a product of a reduced braking force $F_2=F_1\times(a+b)$.

* * * * *